United States Patent [19]

Ohashi

[11] Patent Number: 4,773,606

[45] Date of Patent: Sep. 27, 1988

[54] YARN SPLICING CONTROLLING SYSTEM FOR AN AUTOMATIC WINDER

[75] Inventor: Kenji Ohashi, Uji, Japan

[73] Assignee: Murata Kikai Kabushiki Kaisha, Kyoto, Japan

[21] Appl. No.: 34,477

[22] Filed: Apr. 2, 1987

[30] Foreign Application Priority Data

Apr. 8, 1986 [JP] Japan ..... 61-80819

[51] Int. Cl.[4] ..... B65H 54/26

[52] U.S. Cl. ..... 242/35.6 R; 242/35.5 R; 242/36

[58] Field of Search ..... 242/35.6 R, 35.5 R, 242/35.5 A, 36, 37 R

[56] References Cited

U.S. PATENT DOCUMENTS 2,736,505 2/1956 Furst et al. ..... 242/36
2,752,103 6/1956 Furst ..... 242/36
2,752,104 6/1956 Furst ..... 242/36
3,078,054 2/1963 Furst ..... 242/35.5 R
3,399,840 9/1968 Hayashi et al. ..... 242/35.6 R X

*Primary Examiner*—Stanley N. Gilreath
*Attorney, Agent, or Firm*—Spensley Horn Jubas & Lubitz

[57] ABSTRACT

A yarn splicing controlling system for an automatic winder wherein an operating bogie truck which travels along a row of winding units has provided thereon an automatic processing device for detecting a yarn splicing disabled condition indicating means and for developing a yarn splicing instruction, whereby a yarn splicing instruction for causing the winding unit in the stopped condition as yarn splicing is impossible to perform a yarn splicing operation thereon is compulsorily applied from the travelling bogie truck side.

14 Claims, 6 Drawing Sheets

YARN SPLICING CONTROLLING SYSTEM FOR AN AUTOMATIC WINDER

FIELD OF THE INVENTION AND RELATED ART STATEMENT

This invention relates to a yarn splicing controlling system for an automatic winder.

An automatic winder wherein a large number of winding units are arranged in a juxtaposed relationship and either an automatic yarn splicing device is provided for each of such winding units or a yarn splicing bogie truck is provided for movement along each plurality of ones of such winding units.

In an automatic winder which includes such automatic yarn splicing devices, a yarn may be compulsorily cut in order to remove a defect of the yarn during winding, or a yarn on a spinning bobbin on the yarn supply side may be used up, or else a yarn may be cut by some other reasons. In any of such cases as described above, the winding operation is stopped once, that is, a drum for driving a winding package is stopped, and then in the case of a winder wherein a yarn splicing device is provided for each winding unit, a yarn splicing operation is initiated immediately to splice an end of a yarn on the winding side and an end of another yarn on the supply side to each other by means of the associated yarn splicing device. To the contrary, in the case of a winder wherein a yarn splicing bogie track travels along a plurality of winding units, a yarn splicing instruction signal is developed mechanically or electrically from one of the winding units in which a yarn is cut, and thus the yarn splicing bogie truck duiing traveling stops at a position adjacent the winding unit from which the yarn splicing instruction is developed and performs required yarn processing.

In a winder of either type, if yarn splicing is attempted at a winding unit and is performed successfully, winding operation is resumed, but if such yarn splicing fails even by a predetermined number of yarn splicing attempts, a yarn splicing disabled condition indicating means of the winding unit is caused to make an indication as yarn splicing is impossible. Thus, if an operator finds out from such an indication a winding unit which is in a stopped condition as yarn splicing is impossible, the operator will perform a required processing operation to remove a cause of such yarn splicing disabled condition and cancel the indication of a yarn splicing disabled condition. Consequently, a yarn splicing operation is automatically resumed on the winding unit.

As apparent from foregoing description, conventionally a winding operation on a winding unit on which yarn splicing is disabled or impossible can be resumed only after completion of readjustment thereof by an operator. Accordingly, winding operation of the winding unit is held stopped for an interval of time until the winding unit is found out by an operator after an indication of a yarn splicing disabled condition was made. However, depending upon a cause of such a yarn splicing disabled condition, for example, in case it is determined that yarn splicing is impossible because bobbins have not been supplied on the yarn supply side during a preset number of successive yarn splicing attempts and accordingly an indication of a yarn splicing disabled condition is made but bobbins are supplied after then, if a further yarn splicing attempt is made, yarn splicing may possibly be performed successfully.

If even a winding unit wherein a further yarn splicing attempt may possibly result in success in yarn splicing is held stopped in this manner, the working efficiency of the winding unit will be deteriorated.

OBJECT AND SUMMARY OF THE INVENTION

It is an object of the present invention to propose a yarn splicing controlling system for an automatic winder, whereby a working efficiency of the winder can be improved.

The present invention provides a yarn splicing controlling system for an automatic winder wherein an operating bogie truck which travels along a row of winding units has provided thereon an automatic processing device for detecting a yarn splicing disabled condition indicating means and for developing a yarn splicing instruction, whereby a yarn splicing instruction for causing the winding unit in the stopped condition as yarn splicing is impossible to perform a yarn splicing operation thereon is compulsorily applied from the traveling bogie truck side in order that yarn splicing may be performed on the winding unit wherein a further yarn splicing attempt may possibly result in success in yarn splicing without waiting an operator.

DETAILED DESCRIPTION OF PREFERRED EMBODIMENTS

Now, an embodiment of the present invention will be described with reference to the drawings.

Figure 1:
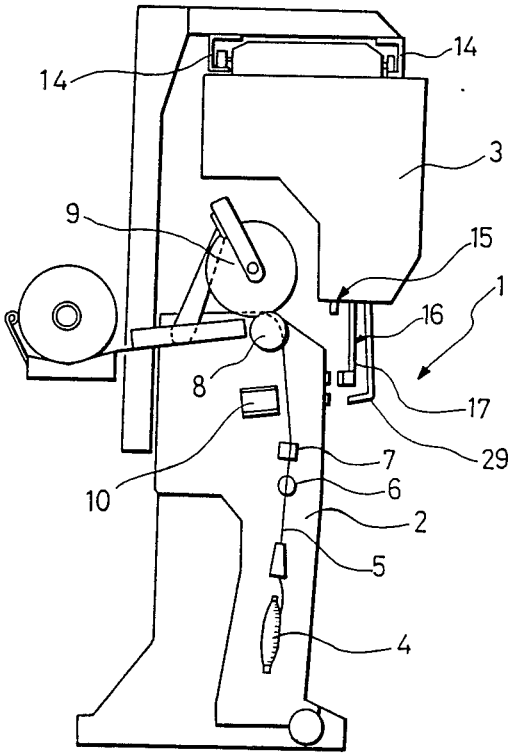
FIG. 1 is a side elevational view illustrating an embodiment of a winder.
Figure 2:
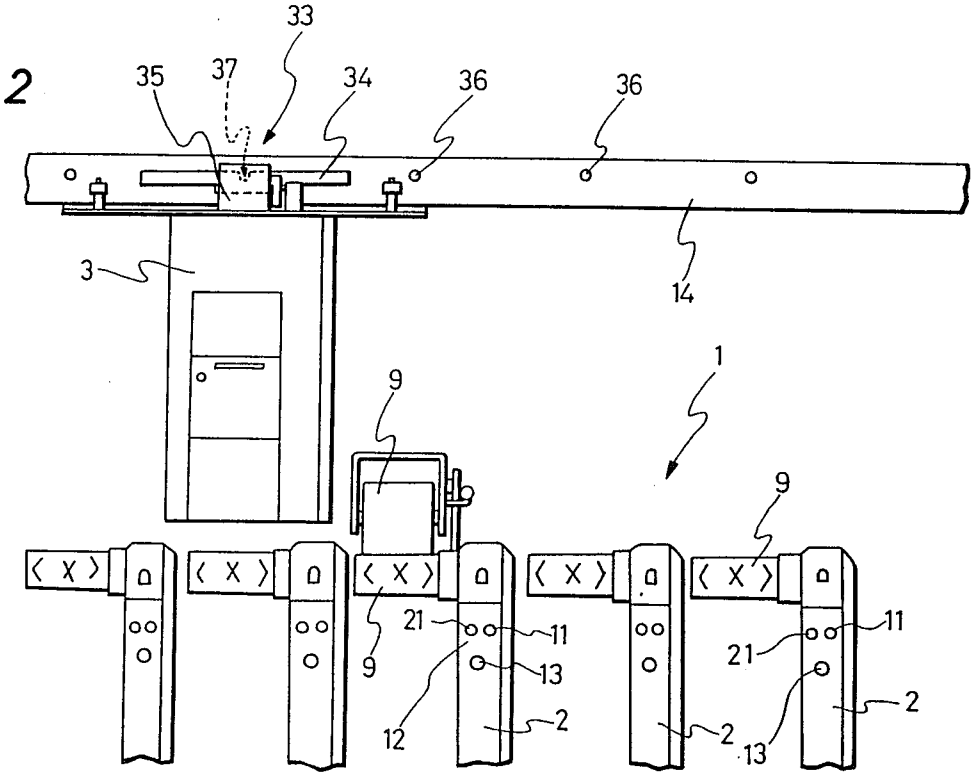
FIG. 2 a front elevational view of the winder of FIG. 1.

Referring to FIGS. 1 and 2, an automatic winder 1 includes a large number of winding units 2 arranged in a row, and an operating bogie truck 3 is provided for traveling movement along the row of the winding units 2. In the case of the present embodiment, the operating bogie truck 3 may be a bogie truck of the type wherein an automatic doffing device is incorporated.

Each of the winding units 2 acts to wind a preset amount of a yarn drawn out from a yarn supply bobbin 4 and passing a tension device 6, a slub catcher 7 and some other elements onto a winding package 9 which is rotated by a traverse drum 8. A yarn splicing device 10 is provided for each of the winding units 2 and operates to splice an end of a yarn on the bobbin 4 side to an end of another yarn on the package 9 side by a known means.

Meanwhile, located at a front portion of each of the winding units 2 is a yarn splicing disabled condition indicating means 12 including a forwardly projected button 11 which is projected forwardly when yarn splicing has finally failed after a predetermined number of yarn splicing attempts. Accordingly, so far as the button 11 is at its projected position, the winding unit is held stopped from winding, and depression of the button 11 will automatically resume a yarn splicing operation. Another button 13 is provided for activation of the traverse drum 8. In particular, the button 11 for indication of a yarn splicing disabled condition can be positioned alternatively to a projected position and a depressed position, while the other button 13 is a switch button wherein, when it is depressed, its switch is turned on to start rotation of the drum, but if a hand of an operator is removed from the button, the button is returned to its original projected position by a force of an associated spring while the drum continues its rotation.

Meanwhile, the operating bogie truck 3 is supported on and depends from a pair of ceiling rails 14 by means of wheels and reciprocally travels or circulates along the row of the winding units 2. It is to be noted that while the bogie truck 3 in the present embodiment is described as an automatic doffing bogie truck, it may be a bogie truck of any other type such as, for example, a bobbin supplying bogie truck which travels along a rail on a floor below winding units and supplies spinning bobbins to the winding units in the course of such travel or any other traveling member which travels along winding units.

As shown in FIG. 1, the bogie truck 3 has mounted thereon a means 15 for detecting a yarn splicing disabled winding unit and a yarn splicing instructing means 16 operable in response to the detecting means 15 for canceling an indication of a yarn splicing disabled condition to compulsorily cause the yarn splicing disabled winding unit to perform a yarn splicing operation. In the present embodiment, the detecting means 15 may be a photoelectric tube sensor while the yarn splicing instructing means 16 may be an arm 17 for depressing the button 11 described above.

Figure 3:
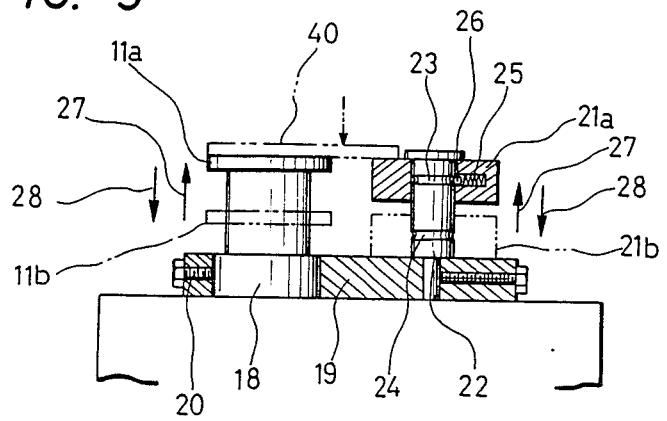
FIG. 3 a plan view showing an embodiment of yarn splicing disabled condition indicating means.
Figure 4:
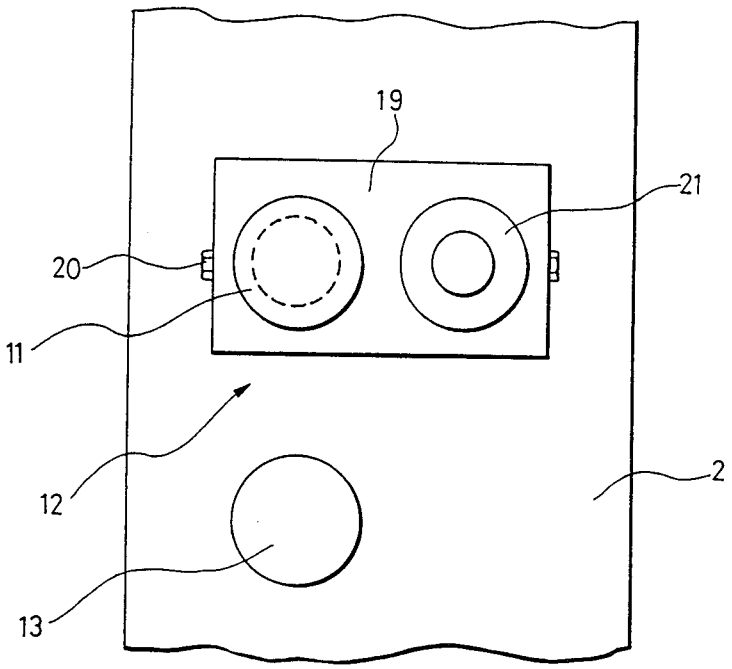
FIG. 4 a front elevational view of the yarn splicing disabled condition indicating means of FIG. 3.

Referring now to FIGS. 3 and 4, the yarn splicing disabled condition indicating means 12 is shown. During normal winding, the button 11 of the indicating means 12 is positioned at a position 11*b* indicated by a chain line but is projected to another position 11*a* indicated by a solid line when yarn splicing has failed. Thus, if the button 11 at the projected position 11*a* is compulsorily depressed, a yarn splicing operation of the winding unit is initiated again. A pushbutton switch 13 is also provided for starting the traverse drum 8.

A holder 18 for the yarn splicing disabled condition indicating button 11 is secured to the winding unit 2, and a bracket 19 is secured to the holder 18 by means of a screw 20. An auxiliary button 21 for operation by an operator to indicate a yarn splicing enabled condition is mounted for sliding movement between a projected position 21*a* indicated by a solid line in FIG. 3 and another depressed position 21*b* indicated by a chain line on a pin 22 securely mounted on the bracket.

In particular, the pin 22 has two annular grooves 23, 24 formed in an axially spaced relationship thereon, and a ball 26 is urged toward the pin 22 from inside of the button 21 by a spring 25 so that it may be alternatively received in the groove 23 or 24 thereby to define the two positions of the button 21 relative to the pin 22 and hence the bracket 19. Movement of the auxiliary button 21 in a direction of an arrow mark 27 from the chain line position 21*b* to the solid line position 21*a* is normally effected by an operator, and only reverse movement thereof in an opposite direction of another arrow mark 28 is effected by the yarn splicing instructing arm 17 on the bogie truck 3. It is to be noted that movement of the yarn splicing disabled condition indicating button 11 in the direction of the arrow mark 27 is effected in response to an instruction signal from the winding unit, and reverse movement thereof in the direction of the arrow mark 28 is effected by the yarn splicing instructing arm 17 at a same timing with that of the auxiliary button 21. Referring again to FIG. 1, an arm 29 is also provided for depressing the button 13 after a doffing operation has been completed.

Exemplary operation of the buttons 11, 21 and the yarn splicing instructing arm 17 as well as an operator will now be described.

Figure 7A:
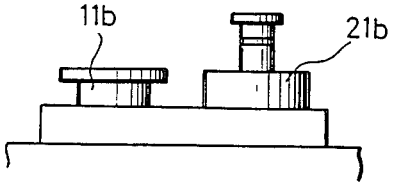
FIGS. 7A to 7D are plan views showing different positions of the first and second buttons 11, 21 according to an embodiment of the present invention.

It is assumed here that, for example, the yarn splicing disabled condition indicating button (hereinafter referred to as first button) 11 and the auxiliary button (hereinafter referred to as second button) 21 are at their respective depressed positions (each hereinafter referred to as B position) as seen in FIG. 7A and thus winding is proceeding in a regular manner at the winding unit 2.

Figure 7B:
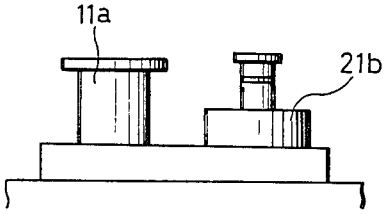

In this condition, if a yarn breaks, a yarn splicing operation is attempted at the winding unit 2. However, if such attempts by a predetermined number of times fail in yarn splicing, it is finally determined that yarn splicing is impossible at all, and consequently the first button 11 is shifted to its projected or A position as shown in FIG. 7B. In this instance, the second button 21 remains at its B position. In such a position as shown in FIG. 7B, if the bogie truck 3 comes to a position adjacent the winding unit 2, the arms 17, 29 of the truck 3 will not operate and the truck 3 will only pass by the winding unit 2 because the sensor 15 is located on the bogie truck 3 such that it may not detect the second button 21 when the second button 21 is at its B position.

Figure 7C:
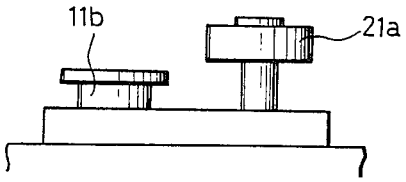

Then, an operator will find the winding unit 2 and thus process ends of yarns so as to allow subsequent splicing thereof and then depress the first button 11*a* to the B position to initiate a yarn splicing operation. Thereupon, the second button 21 will be shifted to the A position by the operator as seen in FIG. 7C. Accordingly, when the first button 11*a*, is depressed by an operator, the operator must return the second button 21 to the A position without fail.

In this condition, if yarn splicing is performed successfully at the winding unit 2, winding at the winding unit 2 is resumed while the yarn splicing disabled condition indicating means remains in its position as shown in FIG. 7C.

In this condition, if the bogie truck 3 comes to the winding unit 2, the first button 11 will not be detected because the first button detecting sensor 15 is located so as to detect only the first button 11 at its A position. Accordingly, the bogie truck 3 will pass by the winding unit 2 without doing any operation.

Figure 5:
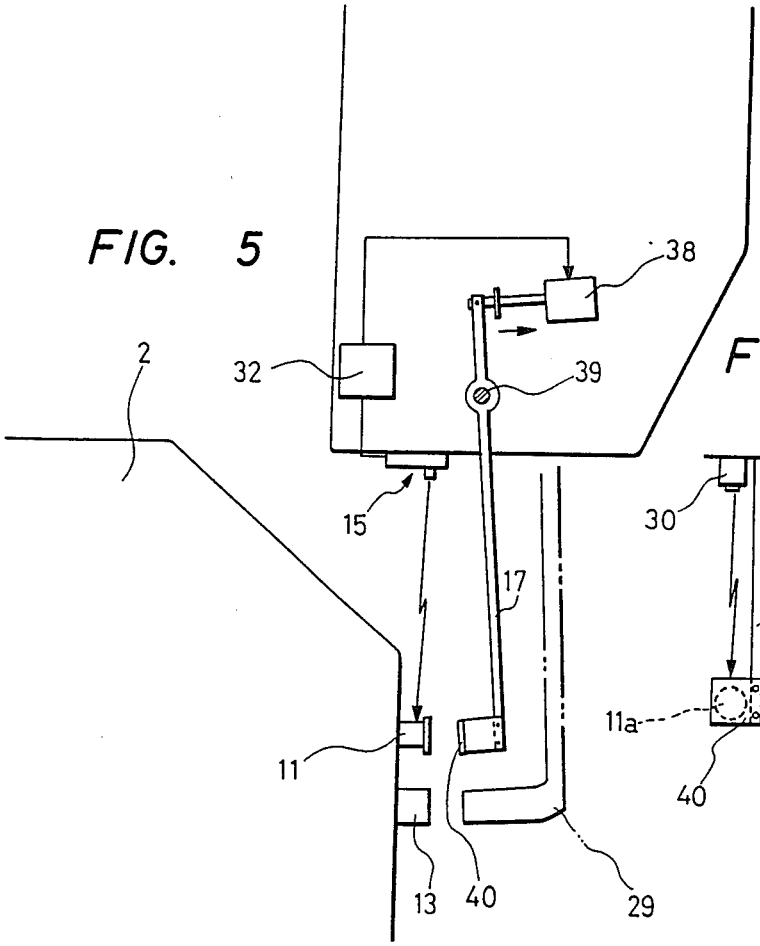
FIG. 5 a side elevational view illustrating a relationship between a bogie truck and first and second buttons according to an embodiment of the present invention.
Figure 6:
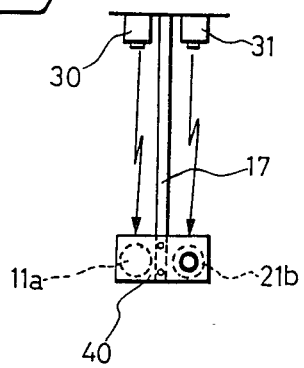
FIG. 6 a front elevational view of the same part as that of FIG. 5.
Figure 7D:
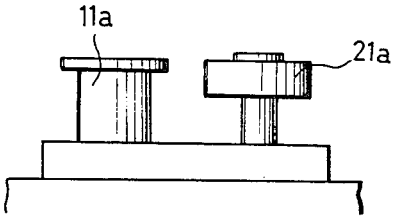

Meanwhile, if in the condition as shown in FIG. 7C a yarn breaks and subsequent yarn splicing finally fails even with a predetermined number of yarn splicing attempts, the first button 11 is projected to the A position. Thus, both of the first and second buttons 11, 21 are now at their respective A positions as seen in FIG. 7D. In this condition, if the bogie truck 3 comes to the winding unit 2, a pair of sensors 30, 31 located on the bogie truck 3 detect the first and second buttons 11, 21, respectively, as shown in FIGS. 5 and 6. Thus, a detection signal of the first button 11 and a detection signal of the second button 21*a* are delivered to an AND circuit of a controlling device 32 which thus operates a truck stopping device 33 shown in FIG. 2. In particular, a bogie truck positioning plate 34 shown in FIG. 2 is released from a solenoid 35 which operates in response a signal from the AND circuit and consequently is shifted to a position corresponding to a positioning pin 36 which extends over the rails 14. Consequently, as the bogie truck 3 further travels due to its own inertia, a recess 37 formed on the plate 34 finally comes to the pin 36 and thus receives the pin 36 therein. As a result, the bogie truck 3 is stopped at a predetermined position.

Subsequently, in response to a signal from the controlling device 32 shown in FIGS. 5 and 6, a solenoid 38 operates to pivot the arm 17 by a predetermined angle in a clockwise direction around a shaft 39 secured to the bogie truck 3. As a result, the first and second buttons 11, 21 are depressed at a same time by a button depressing plate 40 at an end of the arm 17 so that a yarn splicing operation is performed for the winding unit 2. Accordingly, the buttons 11, 21 are now in such positions as shown in FIG. 7A. There is no problem if yarn splicing is performed successfully by a yarn splicing operation of the bogie truck 3 which operates in response to a yarn splicing instruction delivered when the first and second buttons 11, 21 are in the condition shown in FIG. 7D. To the contrary, if yarn splicing finally fails and then the first button 11 is shifted to the A position, that is, if the condition shown FIG. 7B is reached, a further attempt of yarn splicing operation made in response to an instruction on the bogie truck 3 side will result in a very low probability of success. This is because in this instance an end of a yarn on a package clings to such a degree that it may not be picked up from the package by a mere attracting force or else supply of bobbins on the yarn supply side is stopped so that it is impossible to pick up an end of a yarn on a bobbin. In such a case, some readjustment is required.

In other words, in such a case, even if the arm 17 on the bogie truck 3 depresses the first button 11 again to perform a yarn splicing operation, the probability of success in yarn splicing is very low, and accordingly no yarn splicing instruction is developed by the bogie truck 3 in the condition shown in FIG. 7B.

In summary of the operations described above, in the case of an indication of a yarn splicing disabled condition which is made after an operator has made a required processing, an automatic yarn splicing instruction is developed by the bogie truck 3, but in the case of an indication of a yarn splicing disabled condition which is made after the bogie truck 3 has made a necessary processing, no yarn splicing instruction is delivered by the bogie truck 3.

In other words, after processing by an operator, winding by the winding unit 2 is resumed, and in this condition, even a yarn break occurs and an indication of a yarn splicing disabled condition is made for the first time, there is some possibility of success in yarn splicing by a subsequent yarn splicing operation.

To the contrary, in case an automatic processing, that is, depression of the yarn splicing instruction button, is made by the bogie truck 3 so as to perform a yarn splicing operation, if yarn splicing is subsequently made successfully, there is no problem, but on the contrary if yarn splicing fails, the winding unit 2 remains stopped without resuming a winding operation. Accordingly, even if another yarn splicing instruction is delivered to the bogie truck 3 when the bogie truck 3 comes to the winding unit in the stopped condition, the probability of success in yarn splicing is very low. Therefore, in such a case, the bogie truck 3 passes by the winding unit 2 without performing an automatic processing thereby.

It is to be noted that in case yarn splicing performed in response to a yarn splicing instruction developed by the bogie truck 3 goes successfully and winding is resumed whereafter a yarn break occurs and subsequent yarn splicing fails, the system is in the condition as shown in FIG. 7B and no further yarn splicing instruction is developed from the bogie truck 3 in the present embodiment. However, also in such a case, if a further yarn splicing instruction is developed so as to perform a further yarn splicing operation, there is some possibility of success. Accordingly, even though such a case is ignored, if automatic processing by the bogie truck 3 is performed only for those winding units 2 which are in the condition as shown in FIG. 7D among the winding units 2 on which an indication of a yarn splicing disabled condition is made, there is some possibility that winding may be resumed on at least 50 percent or so of the winding units wherein the first button is at its A position.

It is to be noted that it is also possible to perform automatic processing by the bogie truck for every one of the winding units wherein the first button is at its A position. In such a case, there is no necessity of provision of the auxiliary button 21, and only if the button 11 at the A position is detected, the yarn splicing instruction arm can be activated to perform such automatic processing. However, it is very inefficient and uneconomic that the winding units having no or little probability of success in yarn splicing are caused to make an attempt to perform a yarn splicing operation. Besides, it may cause delay of doffing at the remaining winding units due to useless stopping of the bogie truck or may cause napping on a surface of a package or damage to a yarn layer due to repetitions either of attraction of the surface of the package by a suction mouth for picking up an end of the yarn on the package side or due to repetitions of forward and reverse rotations of the package, resulting in deterioration in quality of the wound up package.

This is why in the present embodiment automatic processing by the bogie truck is performed for those of the winding units on which an indication of a yarn splicing disabled condition is made after it has been processed by an operator.

It is to be noted that while in the embodiment described above the bogie truck 3 is stopped when the buttons 11, 21 are to be depressed by the single depressing plate 40 as shown in FIG. 3, it is naturally possible for the buttons 11, 12 to be depressed by the bogie truck 3 while the bogie truck 3 is traveling without stopping.

Figure 8:
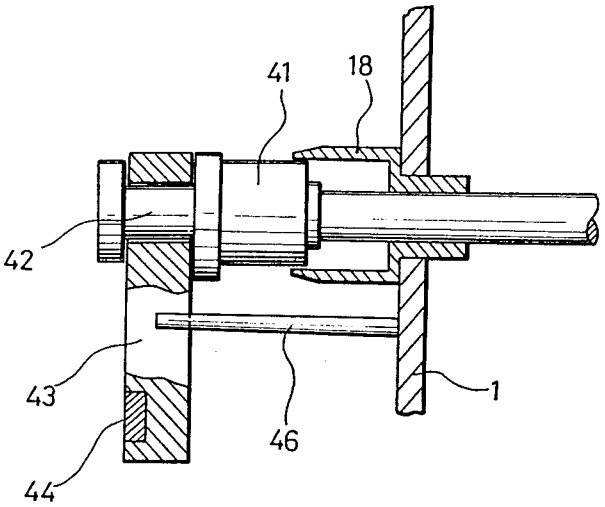
FIG. 8 is a cross sectional side elevational view illustrating another embodiment of a yarn splicing disabled condition indicating means.
Figure 9:
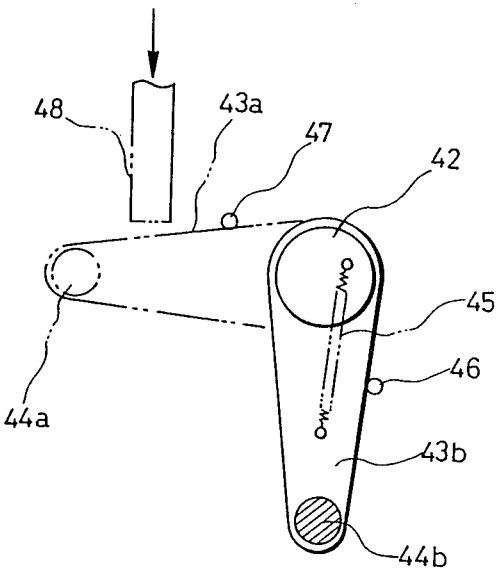
FIG. 9 a front elevational view of the yarn splicing disabled condition indicating means of FIG. 8.

FIGS. 8 and 9 illustrate another example of yarn splicing disabled condition indicating means. In particular, a button 41 shown in FIG. 8 corresponds to the first button 11 of FIG. 3. Thus, the button 41 is shifted to its projected position as shown in FIG. 8 in response to a signal from a winding unit after final failure in a predetermined number of yarn splicing attempts. The button 41 has a stem 42 formed integrally thereon, and an auxiliary lever 43 made of a plastics material is loosely fitted on the stem 42 of the button 41. A magnet 44 is securely mounted at an end of the auxiliary lever 43, and an adjacent sensor located on the bogie truck 3 is turned on or off in response to a position of the magnet 44. A spring 45 extends between the lever 43 and the stem 42 of the button 41 and urges the lever 43 in a counter-clockwise direction when the lever 43 is in a position **43*b* as indicated by a solid line in FIG. 9 but urges the lever 43 in a clockwise direction when the lever 43 is in a position 43*a* as indicated by a chain line in FIG. 9. The lever 43 is thus positioned stably to either of the two positions by a pair of stops 46, 47. Thus, the lever 43 is turned and positioned to the chain line position 43*a* after an operator has made required processing for the winding unit 2 wherein the button 41 was projected, and accordingly the lever 43 corresponds to the auxiliary button 21** in the preceding embodiment.

Accordingly, it is a matter of course that a sensor for detecting the button 41 at its projected A position and another sensor for detecting the magnet 44 on the lever 43 at the chain line position **44*a* are provided on the bogie truck 3**.

Further, an operating member 48 for returning the lever 43 from its chain line position **43*a* to its full line position 43*b* after development of a yarn splicing instruction is provided on the bogie truck 3**.

Processing operations in the arrangement shown in FIGS. 8 and 9 are similar to those of the embodiment shown in FIGS. 1 to 7.

As apparent from the foregoing description, according to the present invention, a yarn splicing instruction is automatically delivered from a bogie truck during traveling to one of winding units which is in a stopped condition as yarn splicing is impossible thereon. Consequently, winding is resumed without waiting for processing by an operator. Accordingly, the working efficiency of the winder can be improved. This is effective for a mill in which a large number of winders are installed and particularly for a mill in which a large number of winding units are shared by each operator.

What is claimed is:

1. A yarn splicing controlling system for controlling the operation of a plurality of winding units of an automatic winder, said system comprising:

a travelling bogie truck operable for travelling adjacent said plurality of winding units; and an automatic processing means provided on said travelling bogie truck, said automatic processing means having detecting means for detecting winding units on which said winding operation is stopped, said automatic processing means further having control means responsive to said detection of winding units for providing a yarn splicing initiation instruction for initiating a yarn splicing operation on said winding units detected by said detection means.

2. A yarn splicing controlling system for controlling the operation of a plurality of yarn splicing devices provided on a corresponding pllurality of winding units of an automatic winder, said system comprising:

a travelling bogie truck operable for travelling adjacent said plurality of winding units;

a yarn splicing disabled condition indicating means, located on each winding unit of said plurality of winding units, operable for indicating the disablement of said yarn splicing device disposed on said winding unit;

detecting means disposed on said travelling bogie truck for detecting a winding unit on which the yarn splicing device is disabled; and a yarn splicing instructing means having cancellation means, responsive to said detecting means, for canceling an indication of a yarn splicing disabled condition indicated by said yarn splicing disabled condition indicating means.

3. A yarn splicing controlling system as claimed in claim 2, wherein said yarn splicing disabled condition indicating means comprises:

a first button positionable in a first position and a second position;

positioning means for positioning said first button in said first position upon a predetermined number of yarn splicing failures;

a manually positionable auxiliary button manually positionable in a first position upon enablement of said yarn splicing device; and yarn splicing initiation means operable for initiating a yarn splicing operation upon said first button being positioned in said second position.

4. A yarn splicing controlling system as claimed in claim 3, further comprising:

a traverse drum;

wherein said yarn splicing disabled condition indicating means further comprises a second button for activating said traverse drum.

5. A yarn splicing controlling system as claimed in claim 3, further comprising:

a yarn splicing instructing arm disposed on said travelling bogie truck;

wherein said manually positionable auxiliary button comprises sliding means for sliding movement between said first position and a second position, said sliding means being maually slidable to said first position; and wherein said yarn splicing instructing arm is operable for sliding said sliding means to said second position.

6. A yarn splicing controlling system as claimed in claim 5, wherein said detecting means comprises a photoelectric tube sensor and said yarn splicing instructing means comprises said yarn splicing instructing arm.

7. A yarn splicing controlling system as claimed in claim 2, wherein said yarn splicing disabled condition indicating means comprises:

a button automatically positionable in a first position upon a predetermined number of failed yarn splicing attempts, said button having a stem;

an auxiliary lever rotatably disposed on said stem, and a magnet disposed on said auxiliary lever.

8. A yarn splicing controlling system as claimed in claim 7, further comprising:

a first sensor, provided on said travelling bogie truck, for detecting said button at its first position; and a second sensor, provided on said travelling bogie truck, for detecting said magnet on said auxiliary lever at a rotated position.

9. A yarn splicing controlling system as claimed in claim 8, further comprising an operating member, disposed on said travelling bogie truck, for returning said auxiliary lever from its rotated position to its original position.

10. A system for controlling the yarn splicing operations of a yarn splicing device, said system comprising:

a first indicator having a first indicating state and a second indicating state;

a second indicator having a first indicating state and a second indicating state;

first detection means for detecting a predetermined number of failed yarn splicing operations;

state altering means responsive to said detection of a predetermined number of failed yarn splicing operations for altering the state of said first indicator to said first indicating state; and activation means for activating said yarn splicing device upon said first indicator being in said second indicating state.

11. A system as claimed in claim 10, further comprising:

a second detection means for detecting said first indicator and said second indicator, both in said first indicating states, respectively;

a movable truck movable to a position adjacent said first and second buttons; and a second automatic movement means disposed on said movable truck, said second automatic movement means being responsive to said detecting of said first movable button and said second movable button, both, moved to said first positions respectively, for automatically moving said first and said second buttons to said second positions respectively.

12. A system for operating an indicating device for indicating a failure of a yarn splicing device, said system comprising the steps of:

detecting a first occurrence of a predetermined number of failed yarn splicing attempts;

indicating a first state on a first indicator; processing said yarn for continued yarn splicing operations;

indicating a second state on said first indicator;

indicating a first state on a second indicator; detecting a second occurrence of a predetermined number of failed yarn splicing attempts; and indicating a first state on said first indicator;

whereby said first indicator indicates said first state and said second indicator indicates said first state upon detecting a second occurrence of a predetermined number of failed yarn splicing attempts.

13. A system for controlling yarn splicing operations comprising:

a first indicator having a primary indicating state and a secondary indicating state;

a second indicator having a primary indicating state and a secondary indicating state;

detection means for detecting a predetermined number of failed yarn splicing operations;

first indicating state altering means, operable in response to the detection means, for altering the indicating state of the first indicator from the primary indicating state to the secondary indicating state upon the detection of the predetermined number of failed yarn splicing operations;

second indicating state altering means for altering the indicating state of the first indicator from the secondary indicating state to the primary indicating state and for altering the indicating state of the second indicator from the primary indicating state to the secondary indicating state;

whereby a predetermined number of failed yarn splicing operations occurring after said second indicator has been altered to said secondary indicating state is indicated by the first indicator being in the secondary indicating state and the second indicator being in the secondary indicating state.

14. A method for controlling yarn splicing operations in a yarn splicing system including a first indicator having a primary indicating state and a secondary indicating state and a second indicator having a primary indicating state and a secondary indicating state, said method comprising the steps of:

detecting a predetermined number of failed yarn splicing operations;

altering the indicating state of the first indicator from the primary indicating state to the secondary indicating state upon the detection of the predetermined number of failed yarn splicing operations;

processing the yarn so as to allow continued yarn splicing operations;

altering the indicating state of the first indicator from the secondary indicating state to the primary indicating state; and altering the indicating state of the second indicator from the primary indicating state to the secondary indicating state;

whereby a predetermined number of failed yarn splicing operations occurring after said step of processing the yarn has been performed is indicated by the first indicator being in the secondary indicating state and the second indicator being in the secondary indicating state.

* * * * *